US010217387B2

(12) United States Patent
Huang et al.

(10) Patent No.: US 10,217,387 B2
(45) **Date of Patent: *Feb. 26, 2019**

(54) LED LIGHT ENGINE FOR SIGNAGE

(71) Applicant: General LED, Inc., San Antonio, TX (US)

(72) Inventors: Michelle Kun Huang, San Antonio, TX (US); Glenn Freeman, San Antonio, TX (US); Gray Lankford, San Antonio, TX (US)

(73) Assignee: General LED Opco, LLC, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/471,513

(22) Filed: Mar. 28, 2017

(65) Prior Publication Data

US 2017/0206813 A1 Jul. 20, 2017

Related U.S. Application Data

(63) Continuation-in-part of application No. 14/642,071, filed on Mar. 9, 2015, now Pat. No. 9,626,884, which is a continuation-in-part of application No. 14/215,126, filed on Mar. 17, 2014, now Pat. No. 9,464,780.

(60) Provisional application No. 61/793,101, filed on Mar. 15, 2013.

(51) Int. Cl.

| | |
|---|---|
| ***F21S 4/10*** | (2016.01) |
| ***F21V 5/04*** | (2006.01) |
| ***F21V 23/00*** | (2015.01) |
| ***F21V 31/04*** | (2006.01) |
| ***G09F 13/22*** | (2006.01) |
| ***F21W 131/40*** | (2006.01) |
| ***F21Y 115/10*** | (2016.01) |

(52) U.S. Cl.

CPC ..... *G09F 13/22* (2013.01); *F21S 4/10* (2016.01); *F21V 5/04* (2013.01); *F21V 23/005* (2013.01); *F21V 31/04* (2013.01); *F21W 2131/40* (2013.01); *F21Y 2115/10* (2016.08); *G09F 2013/222* (2013.01); *Y10T 29/4913* (2015.01)

(58) Field of Classification Search

CPC ..... F21V 31/04; F21V 23/001; F21V 15/01; F21V 3/00; F21V 23/005; G09F 13/22; G09F 2013/222; F21W 2131/40; F21Y 2115/10

See application file for complete search history.

(56) References Cited

U.S. PATENT DOCUMENTS

| | | | |
|---|---|---|---|
| 5,559,681 | A | 9/1996 | Duarte |
| 5,577,493 | A | 11/1996 | Parkyn, Jr. et al. |
| 6,074,074 | A | 6/2000 | Marcus |
| 6,566,824 | B2 | 5/2003 | Panagotacos et al. |
| 6,673,292 | B1 | 1/2004 | Gustafson et al. |
| 6,673,293 | B1 | 1/2004 | Mistopoulos et al. |

(Continued)

*Primary Examiner* — Alexander K Garlen

(74) *Attorney, Agent, or Firm* — William H. Quirk; Jesse Frizzell; Rosenthal Pauerstein Sandoloski Agather LLP

(57) ABSTRACT

A durable LED light engine includes a printed circuit board including LEDs mounted thereon positioned between a substantially U-shaped top enclosure and a bottom enclosure. Once assembled together, the combination of the substantially U-shaped top enclosure, the printed circuit board and the bottom enclosure are held together with a molding material.

15 Claims, 10 Drawing Sheets

(56) References Cited

U.S. PATENT DOCUMENTS

| | | | | |
|---|---|---|---|---|
| 6,837,598 | B2 | 1/2005 | Marcus | |
| 6,924,973 | B2 | 8/2005 | Kim | |
| 6,932,495 | B2 | 8/2005 | Sloan et al. | |
| 6,942,360 | B2 | 9/2005 | Chou et al. | |
| 7,036,962 | B2 * | 5/2006 | Chan | A44C 15/0015 362/103 |
| 7,160,140 | B1 | 1/2007 | Mrakovich et al. | |
| 7,165,863 | B1 | 1/2007 | Thomas et al. | |
| 7,241,031 | B2 | 7/2007 | Sloan et al. | |
| 7,429,186 | B2 | 9/2008 | Mrakovich et al. | |
| 7,687,288 | B2 | 3/2010 | Saha et al. | |
| 7,749,813 | B2 | 7/2010 | Kolodin et al. | |
| 7,832,896 | B2 * | 11/2010 | Saha | G09F 13/0409 362/217.05 |
| 7,868,903 | B2 * | 1/2011 | Wendler | G09F 9/33 345/204 |
| 7,915,061 | B2 | 3/2011 | Nall et al. | |
| 7,926,976 | B2 | 4/2011 | Schinzel-Kolb et al. | |
| 7,926,977 | B2 | 4/2011 | Nall et al. | |
| 7,931,386 | B2 | 4/2011 | Nall et al. | |
| 8,083,381 | B2 * | 12/2011 | Tsai | F21V 17/164 362/249.02 |
| 2004/0075399 | A1 | 4/2004 | Hall | |
| 2006/0187668 | A1 | 8/2006 | Howe | |
| 2006/0270105 | A1 | 11/2006 | Takiar et al. | |
| 2008/0220549 | A1 * | 9/2008 | Nall | H05K 3/284 438/26 |
| 2009/0103325 | A1 | 4/2009 | Dubuc | |
| 2011/0085334 | A1 * | 4/2011 | Wang | F21V 31/04 362/249.02 |
| 2013/0049048 | A1 * | 2/2013 | Takeda | F21V 23/002 257/98 |
| 2013/0183779 | A1 * | 7/2013 | Pachler | F21V 21/002 438/28 |
| 2013/0265775 | A1 | 10/2013 | Freeman | |

* cited by examiner

LED LIGHT ENGINE FOR SIGNAGE

CROSS REFERENCE TO RELATED APPLICATIONS

This application is a Continuation-in-Part of prior filed co-pending U.S. patent application Ser. No. 14/642,071, filed Mar. 9, 2015, entitled "LED Light Engine for Signage," which is a Continuation-in-Part of U.S. patent application Ser. No. 14/215,126, filed Mar. 17, 2014, entitled "LED Light Engine for Signage" (now U.S. Pat. No. 9,464,780, issued on Oct. 11, 2016), which claims the benefit of Provisional U.S. Patent Application Ser. No. 61/793,101, filed Mar. 15, 2013, entitled "LED Light Engine for Signage." By this reference, the entire disclosure, including the claims and drawings, of U.S. patent application Ser. No. 14/642,071, U.S. Pat. No. 9,464,780, and Provisional U.S. Patent Application Ser. No. 61/793,101, are hereby incorporated into the present disclosure as if set forth in their entirety.

STATEMENT REGARDING FEDERALLY FUNDED RESEARCH AND DEVELOPMENT

The invention described in this patent application was not the subject of federally sponsored research or development.

FIELD

The disclosed invention relates to a device for using light emitting diodes ("LED") to illuminate signage. More particularly, the present invention relates to a light engine which is attached to other similar light engines to form a string of light engines typically used for retail and commercial sign illumination but may be used for interior lighting, point of sale lighting, and merchandising displays.

BACKGROUND

Conventional flexible lighting systems that incorporate strings of LED light engines are typically used to provide illumination for cabinet or channel letter signs. Such strings of LED light engines are particularly useful with irregularly shaped signage. However, in irregularly shaped signage, the irregular shape of the sign makes it difficult to obtain uniform illumination. Accordingly, there remains a need in the art for a durable LED light engine that can be connected to other durable light engines to form a string of light engines that enables uniform illumination even in irregularly shaped signage.

SUMMARY

The durable LED light engine of the present invention can be connected to other durable light engines to form a string of light engines that enable uniform illumination even in irregularly shaped signage.

The LED light engine of the present invention is constructed around a printed circuit board having LEDs positioned on the top surface thereof and wires attached to electronic componentry preferably positioned on the bottom surface thereof; however, some or all the wires and electronic componentry may be positioned on the top surface of the printed circuit board if desired. Covering the printed circuit board is a substantially U-shaped top enclosure. The substantially U-shaped top enclosure has one or more lenses formed on a top surface thereof. In some embodiments, one lens may be positioned over one or more LEDs in the assembled LED light engine. In other embodiments, the opening to each lens is constructed and arranged to be positioned over an LED in the assembled LED light engine.

In some of the disclosed embodiments, the underside of the substantially U-shaped top enclosure includes one or more alignment projections which pass through alignment holes in the printed circuit board. Underneath the printed circuit board is a bottom enclosure. In such embodiments, alignment receptacles in the bottom enclosure receive the alignment projections extending from the bottom of the substantially U-shaped top enclosure. Other disclosed embodiments make use of a press-fit interface between the substantially U-shaped top enclosure and the bottom enclosure when the LED light engine is assembled, either in combination with other alignment mechanisms or to the exclusion of other alignment mechanisms.

After the printed circuit board is placed between the substantially U-shaped top enclosure and the bottom enclosure, the combination of the substantially U-shaped top enclosure, the printed circuit board and the bottom enclosure are placed in a mold used in a plastic molding machine. A molten plastic sealant material is then injected onto the combination of the substantially U-shaped top enclosure, the printed circuit board and the bottom enclosure. Once cooled, the molten plastic sealant material forms strain reliefs around, and covers the insulated wires positioned on the bottom of the printed circuit board. In some disclosed embodiments, the molten plastic sealant material affixes the substantially U-shaped top enclosure, the printed circuit board and the bottom enclosure one to another. In some of these embodiments, the sealant material does not contact the printed circuit board. In some disclosed embodiments, when injected, the molten plastic sealant material does not flow between the top enclosure and the bottom enclosure. In such embodiments, the sealant material does not contact the printed circuit board in the final assembly of the LED light engine.

BRIEF DESCRIPTION OF THE DRAWING FIGURES

A better understanding of the LED light engine of the present invention may be had by reference to the drawing figures wherein.

DESCRIPTION OF THE EMBODIMENTS

Figure 1:
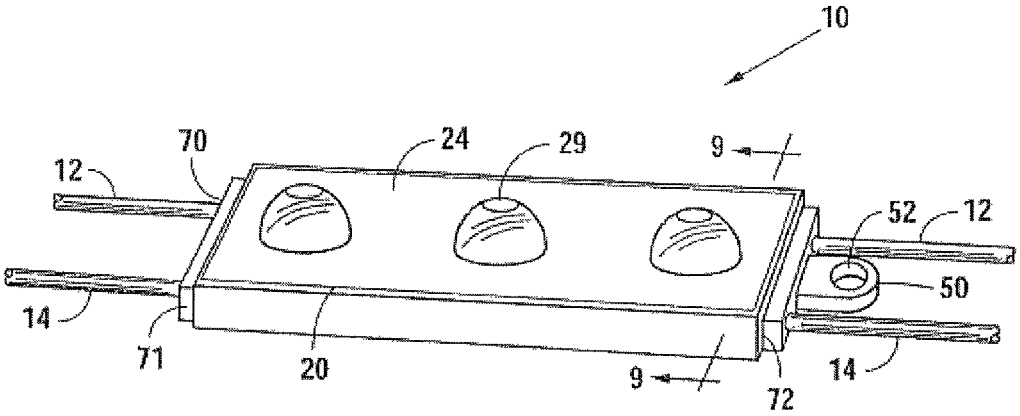
FIG. 1 is a front perspective view of a completed light engine according to the present invention.

The present invention enables a durable LED light engine 10 that may be used for illuminating signage. As shown in FIG. 1, the top of the LED light engine 10 of the present invention is a substantially U-shaped top enclosure 20. Included in the substantially U-shaped top enclosure 20 are lenses 29. These lenses 29 are located over the LEDs contained with the LED light engine 10. Extending from the ends of the LED light engine 10 are insulated wires 12, 14. These insulated wires 12, 14 both provide electrical energy to the LEDs and enable the connection of one LED light engine 10 to another. Also extending from one end of the LED light engine 10 is a projection 50 including a hole 52 formed therein. A fastener may be placed through the hole 52 in the projection 50 to affix the LED light engine 10 to a surface. Surrounding the insulated wires 12, 14 is a sealant material 70 which holds the insulated wires 12, 14 in place and acts as a strain relief 71, 72. The sealant material 70 provides durability, protects the LED light engine 10 from moisture and holds the components of the LED light engine 10 together.

Figure 2:
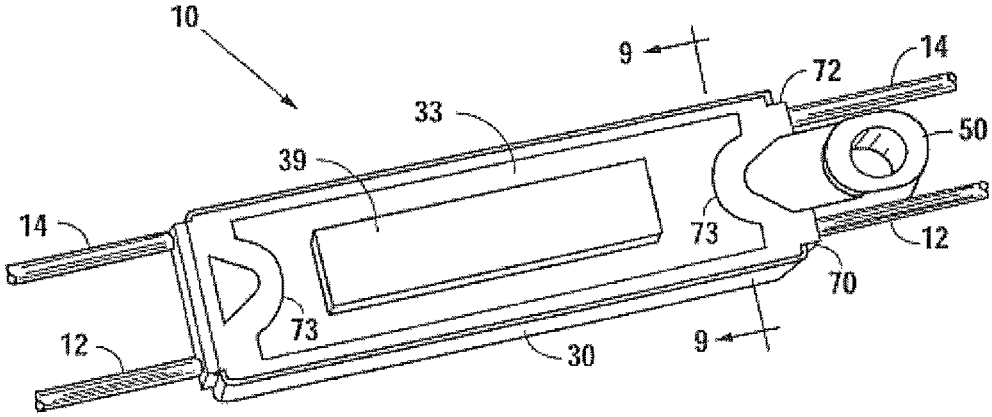
FIG. 2 is a bottom perspective of the completed light engine shown in FIG. 1.

The bottom of the LED light engine 10 is shown in FIG. 2. Therein the flat bottom surface 33 of the bottom enclosure 30 is shown. Optionally, two-sided tape 39 (FIG. 3) may be placed on the bottom surface 33 of the bottom enclosure 30. Use of the two-sided tape 39 provides another way of attaching the LED light engine 10 to a surface. Also shown on the bottom surface 33 of the bottom enclosure 30 are channels 73 filled with sealant material 70. This molten plastic sealant material 70 is contiguous with the strain relief 71, 72 formed around the insulated wires 12, 14 at both ends of the LED light engine 10.

Figure 3:
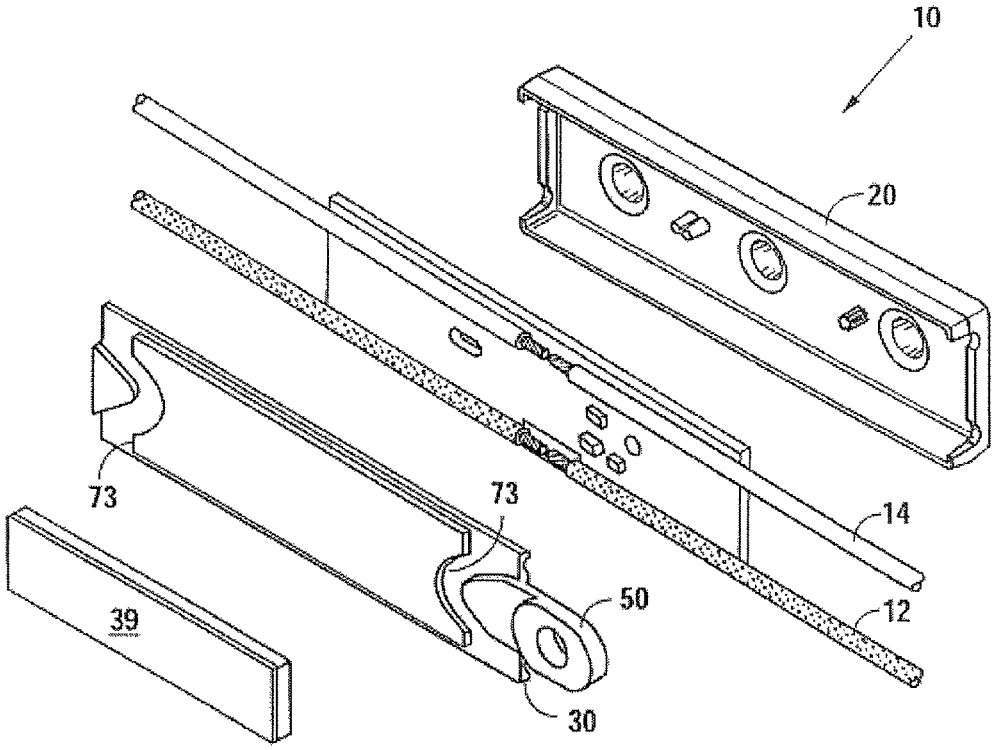
FIG. 3 is an exploded view of the light engine before the injection of the molten plastic sealant.
Figure 8:
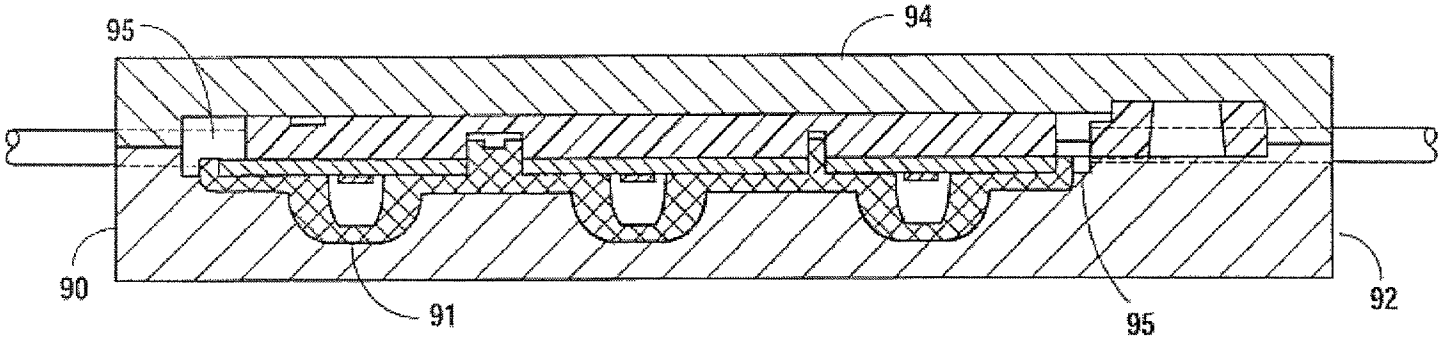
FIG. 8 is an elevational view in partial section of the assembled substantially U-shaped top enclosure, the printed circuit board and the bottom enclosure between the top and bottom of the mold in a plastic molding machine.

A still better understanding of the LED light engine 10 of the present invention may be had by reference to the exploded view shown in FIG. 3. Therein it may be seen that the printed circuit board 40 is effectively sandwiched between the substantially U-shaped top enclosure 20 and the bottom enclosure 30. The placement of the cooled sealant material 70 described above is not shown. As will be explained below, in the preferred embodiment, the substantially U-shaped top enclosure 20, the printed circuit board 40, and the bottom enclosure 30 are assembled one to another before the molten plastic sealant material 70 is injected therebetween. This combination of the substantially U-shaped top enclosure 20, the printed circuit board 40 and the bottom enclosure 30 is placed into a plastic mold (FIG. 8). Once in the plastic mold, the molten plastic sealant material 70 then flows into the openings between the substantially U-shaped top enclosure 20, the printed circuit board 40 and the bottom enclosure 30. When cooled, the molten plastic sealant 70 seals the LEDs 60 and electrical componentry 62 (FIG. 4A) from damage by moisture, provides strain relief around the insulated wires 12, 14, holds the wires in place within the LED light engine 10 and affixes the substantially U-shaped top enclosure 20, the printed circuit board 40 and the bottom enclosure 30 one to another.

Figure 4A:
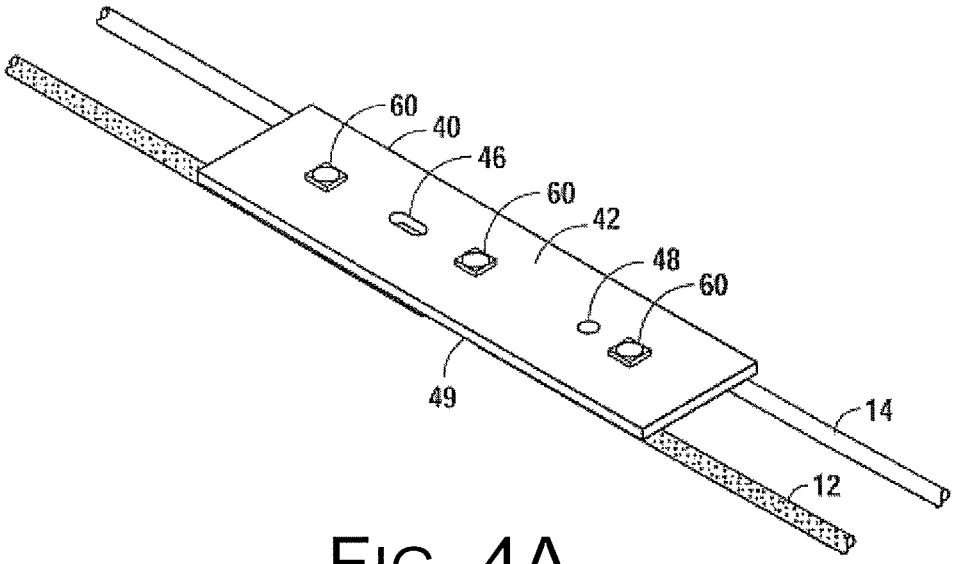
FIG. 4A is a top perspective view of the printed circuit board.

Shown in FIG. 4A is a top view of the printed circuit board 40. Note that three LEDs 60 are located on the top surface 42. While three LEDs 60 are shown in the preferred embodiment, the number of LEDs 60 located on the top surface 42 of the printed circuit board 40 is dependent on the application of the LED light engine 10 and the amount of light required. In the middle of the printed circuit board 40 is an alignment hole 48 and an alignment slot 46. While an alignment hole 48 and an alignment slot 46 are shown, those of ordinary skill in the art will understand that one or more holes or one or more slots may be used for alignment. Formed around the side of the printed circuit board is an edge 49.

Figure 4B:
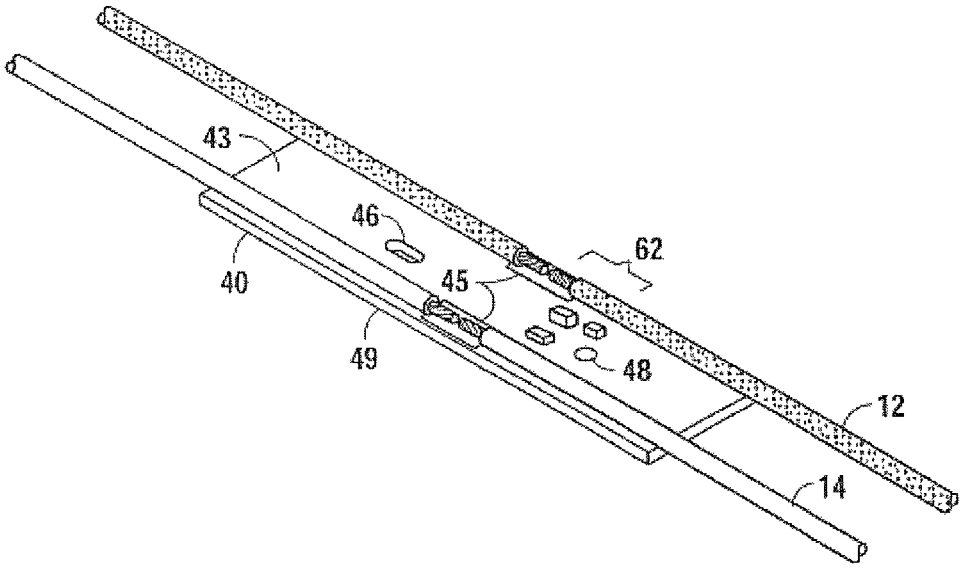
FIG. 4B is a bottom perspective view of the printed circuit board.

Shown in FIG. 4B is a bottom view of the printed circuit board 40. Note that various pieces of electronic componentry 62, to include resistors, diodes and integrated circuit chips, are located on the bottom 43 of the printed circuit board 40. If needed, some or all of the wires and electronic componentry may be placed on top of the printed circuit board 40. Also located on the bottom 43 of the printed circuit board 40 are pads 45 onto which the metal wires contained within the insulation are soldered. Alternatively, a mechanical clamp-type connection may be used to attach the insulated wires 12, 14 to the bottom 43 of the printed circuit board 40. The alignment hole 48 and the alignment slot 46, as well as the edge 49 of the printed circuit board 40 described above appear in FIG. 4A.

Figure 5A:
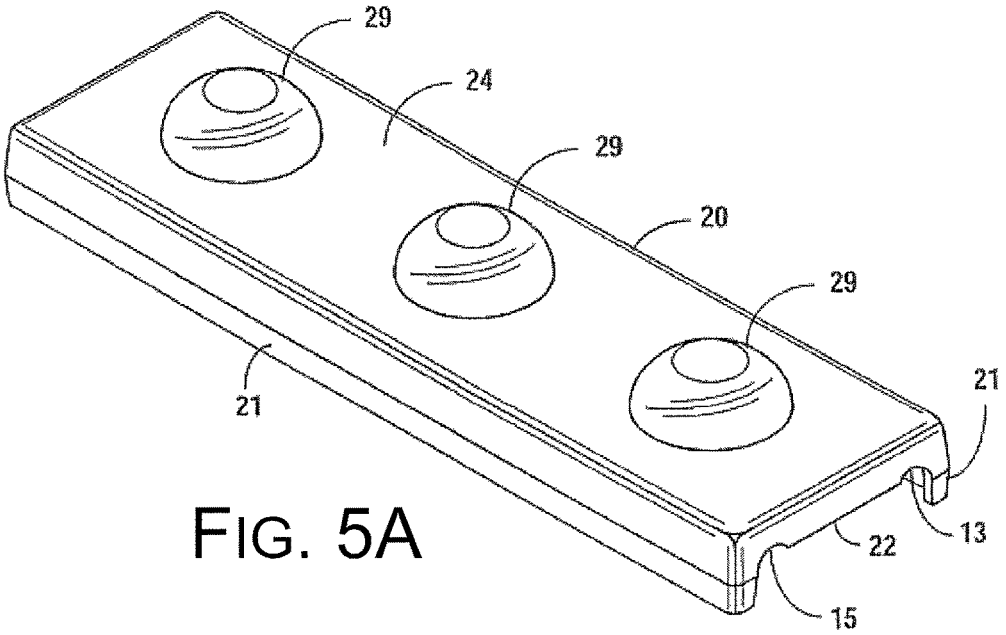
FIG. 5A is a top perspective view of the substantially U-shaped top enclosure.

A top view of the substantially U-shaped top enclosure 20 is shown in FIG. 5A. Therein it may be seen that lenses 29 are formed in the top surface 24 of the substantially U-shaped top enclosure 20. Each one of these lenses 29 is constructed, positioned and arranged to manage the light rays emitted by the LEDs 60. While three lenses 29 are shown in FIG. 5A, the number of lenses depends on the number of LEDs positioned on the top surface 42 of the printed circuit board 40. Also shown in FIG. 5A are the downwardly depending sides 21 which fit over the long edges 49 of the printed circuit board 40. At the ends of the substantially U-shaped top enclosure 20 are downwardly depending ends 22. The downwardly depending ends 22 include arcuate openings 13, 15 which assist in the placement of the insulated wires 12, 14 when the substantially U-shaped top enclosure 20, the printed circuit board 40 and the bottom enclosure 30 are assembled together.

Figure 5B:
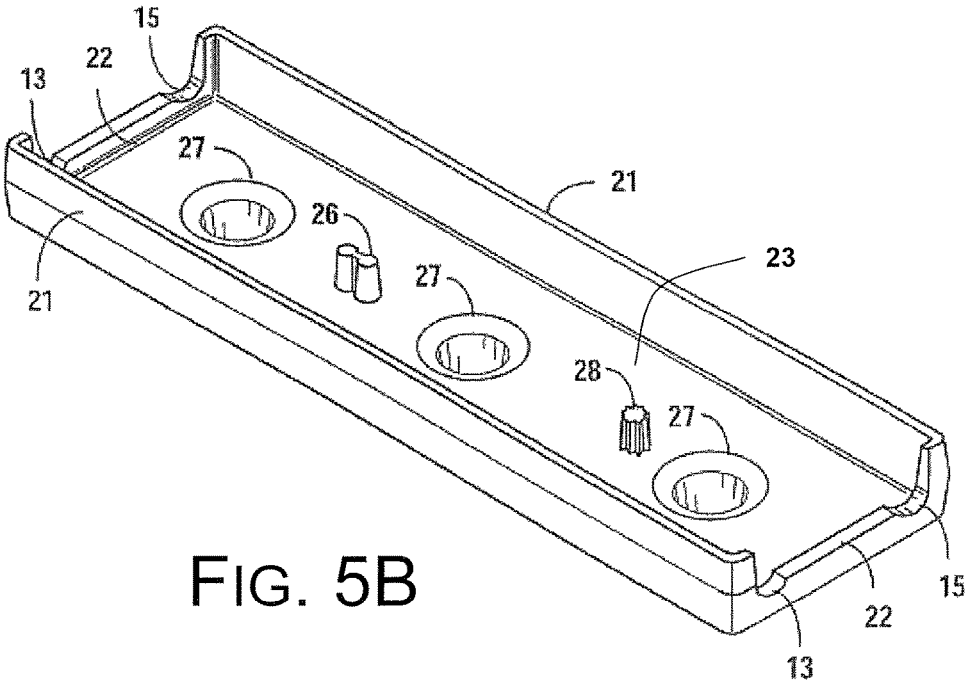
FIG. 5B is a bottom perspective view of the substantially U-shaped top enclosure.

Shown in FIG. 5B is a bottom view 23 of the substantially U-shaped top enclosure 20. Also visible are the lens openings 27. The lens openings 27 are positioned over each LED 60 by the alignment projections 26, 28 constructed, positioned and arranged to enter the alignment slot 46 and the alignment hole 48 formed in the printed circuit board 40. Between the inside surfaces of the downwardly depending sides 21, the downwardly depending ends 22, and around the lens openings 27 is a flat surface 23. As described below, a portion 19 of this flat surface 23 will eventually come into physical contact with the top surface 42 of the printed circuit board 40. It is anticipated that the substantially U-shaped top enclosure 20 will be made using a polymethyl methacrylate ("PMMA") or a polycarbonate ("PC").

Figure 6A:
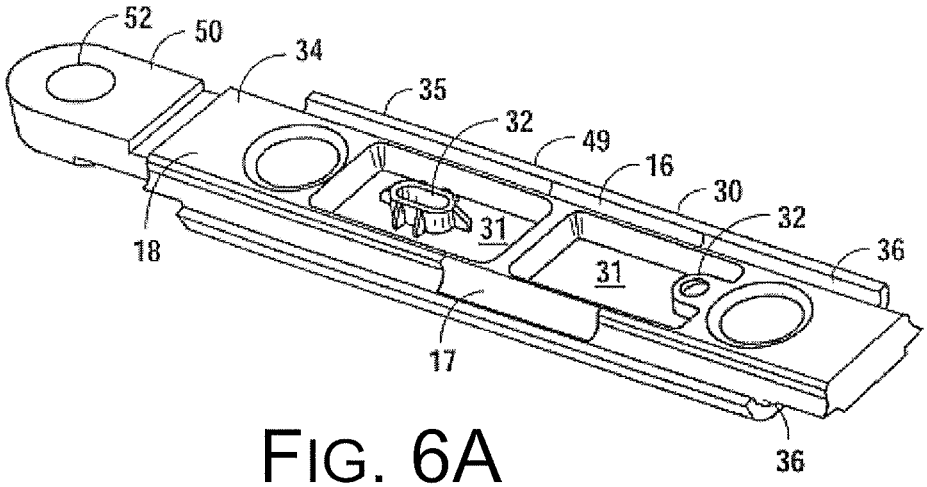
FIG. 6A is a top perspective view of the bottom enclosure.

Shown in FIG. 6A is a top view of the bottom enclosure 30. Along each long side 35 of the bottom enclosure 30 are channels 36. These channels 36 are sized to enable the position and the insertion of the insulated wires 12, 14 therein. Also shown in the top surface 34 of the bottom enclosure 30 are two wells 31. The rightmost well 31 in FIG. 6A is large enough to accommodate the electronic componentry 62 which is positioned on the bottom 43 of the printed circuit board 40 (FIG. 4B). The wells 31 in FIG. 6A contain at least one alignment receptacle 32 into which the alignment projections 26, 28 formed in the bottom of the substantially U-shaped top enclosure 20 pass into after having passed through the alignment hole 48 and an alignment slot 46 formed in the printed circuit board 40. On one end of the bottom enclosure 30 is the projection 50 shown in FIG. 1. As described below, a portion 18 of top surface 34 will eventually come into physical contact with the bottom surface 43 of the printed circuit board 40.

Figure 6B:
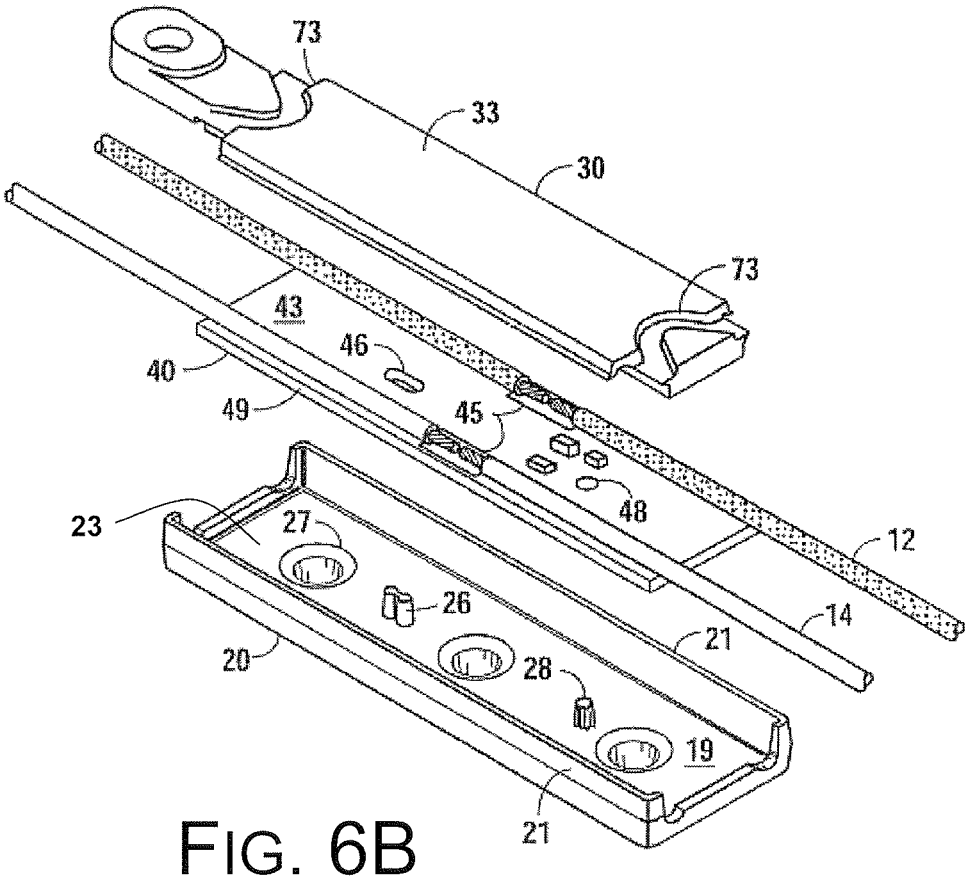
FIG. 6B is an exploded view of the pre-molding assembly of the printed circuit board between the bottom enclosure and the substantially U-shaped top enclosure.

Shown in FIG. 6B is the flat bottom surface 33 of the bottom enclosure 30. As noted above with respect to FIG. 3, the flat bottom surface 33 of the bottom enclosure 30 includes the channels 73 formed therein which will provide paths for the molten plastic sealant material 70 as shown in FIG. 2. It is anticipated that the bottom support enclosure 30 will be manufactured from PMMA, a polycarbonate, an ABS plastic, nylon or PVC.

Also shown in FIG. 6B is the initial step in the pre-molding assembly of the LED light engine 10. The first step is the insertion of the printed circuit board 40 between the downwardly depending sides 21 and into the substantially U-shaped top enclosure 20. The LEDs 60 align with the lenses 29, and the flat portion 19 of the bottom surface 23 of the substantially U-shaped enclosure 20 comes into physical contact with the top surface 42 of the printed circuit board 40. The LEDs 60 become aligned with the lenses 29 by the insertion of the alignment projections 26, 28 through the alignment hole 48 and alignment slot 46 in the printed circuit board 40.

The second step in the pre-molding assembly of the LED light engine 10 is the placement of the bottom enclosure 30 over the bottom 43 of the printed circuit board 40. Herein a portion of the bottom surface 18 (FIG. 6A) surrounding the wells 31 will come into physical contact the bottom 43 of the printed circuit board 40. As explained above, the electronic componentry 62 (FIG. 4B) positioned on the bottom of the printed circuit board 40 will fit into the rightmost well 31 shown in FIG. 6A.

The tops of alignment projections 26, 28 from the bottom surface 23 of the substantially U-shaped top enclosure 20 will engage the alignment receptacles 32 positioned in each well 31 in FIG. 6A. The insulated wires 12, 14 will lie in the channels 36 formed on either side of the bottom enclosure 30. And, as shown in FIG. 6A, those portions of the insulated wires 12, 14, which are soldered to the bottom 43 of the printed circuit board 40, will fit within spaces 16, 17 formed on either side of the bottom enclosure 30.

Figure 7:
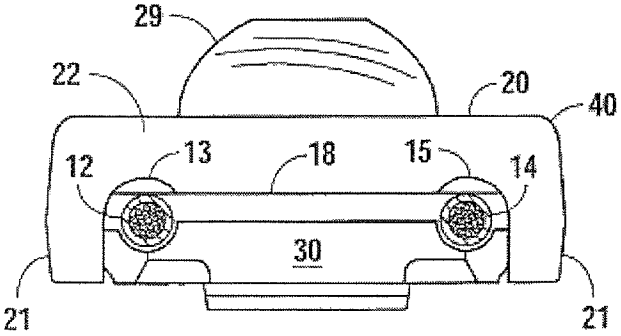
FIG. 7 is an end view in partial section of the assembled components before the injection of the molten plastic sealing material.

Shown in FIG. 7 is the end view of the assembled, but not yet molded, LED light engine 10. Portion 18 of the top surface 34 of the bottom enclosure 30 is placed against the bottom 43 of the printed circuit board 40. The edge 49 of the printed circuit board 40 is positioned within the insides of the downwardly dependent sides 21 of the substantially U-shaped top enclosure 20. The flat portion 19 of the bottom 23 of the substantially U-shaped top enclosure 20 is placed against the top surface 42 of the printed circuit board 40. The combination shown in FIG. 7 illustrates the openings available for the flow of molten sealant material 70 after the combination of the substantially U-shaped top enclosure 20, the printed circuit board 40 and the bottom enclosure 30 have been placed together.

As shown in FIG. 8, the openings 91 formed in the bottom 92 of the plastic mold 90 are sized to engage the lenses 29. When the top of the mold 94 and the bottom of the mold 92 are brought together, the molten sealant material 70 is injected into the combination of the assembled substantially U-shaped top enclosure 20, the printed circuit board 40 and bottom enclosure 30 as shown in FIG. 7. The molten sealant material 70 flows into the pathways formed when the top 94 and the bottom 92 of the plastic mold 90 are brought together. The molten sealant material 70 also fills the channels 36 in which the insulated wires 12, 14 are located. As may be seen in FIG. 9, a portion of the molten sealant material 70 flows inside the downwardly depending side 21 of the substantially U-shaped top enclosure 20 and chemically bonds with the inside of the depending side 21 of the substantially U-shaped top enclosure 20. The molten plastic sealant material 70 also bonds with the edges 49 of the printed circuit board 40. In addition, the molten plastic sealant material 70 also chemically bonds with the bottom enclosure 30 thereby affixing the substantially U-shaped top enclosure 20, the printed circuit board 40 and the bottom enclosure 30 one to another. The sealant material 70 does not flow over the top surface 42 of the printed circuit board 40.

At either end of the plastic mold 90, there is a space 95 surrounding the insulated wires 12, 14. The molten plastic sealant material 70 flows into this space around the outside of the insulated wires 12, 14. A chemical bond between the flowing plastic sealant material 70 and the insulation around the insulated wires 12, 14 is formed, thereby forming a strain relief 71, 72 section around the insulated wires 12, 14. The use of a plastic sealant material 70 also provides moisture resistance for the LEDs 60 and the electronic componentry 62 within the LED light engine 10.

Figure 9:
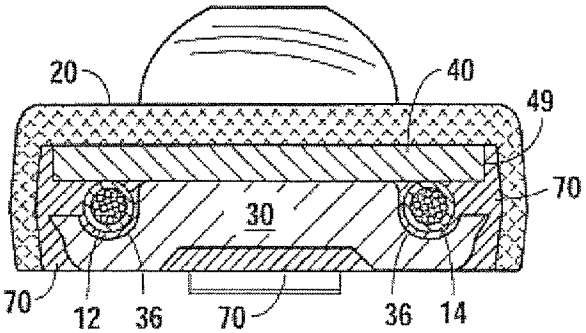
FIG. 9 is a cross-sectional view of the completed light engine at line 9-9 of FIG. 1 and of FIG. 2 showing the location of the cooled plastic sealant material.

The positioning of the cooled plastic sealant material 70 within the completed LED light engine 10 is best shown by reference to FIG. 9. Therein, it may be seen that the molten plastic sealant material 70 flows within the channels 36 and surrounds the insulated wires 12, 14.

While the projection 50 (FIG. 6A) is shown as part of the bottom enclosure 30, those of ordinary skill in the art will understand that the projection 50 may be formed using the plastic sealant material 70 instead of having the projection 50 made a part of the bottom enclosure 30.

Figure 11:
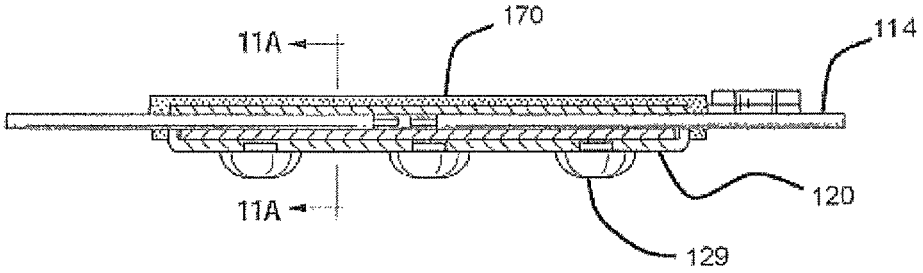
FIG. 11 is a cross-sectional view of the first alternate embodiment of the invention similar to FIG. 9.

In the first alternate embodiment shown in FIG. 11, the top portion of the LED light engine 110 is a substantially U-shaped top enclosure 120. Included in the substantially U-shaped top enclosure 120 are lenses 129. As in the preferred embodiment, insulated wires 112, 114 extend from the ends of the LED light engine 110.

Those of ordinary skill in the art will understand the first alternate embodiment is similar to the preferred embodiment 10. Accordingly, the reference numbers used to describe the parts of the first alternate embodiment are the same, but for the number "1" in the hundreds place of the reference numbers.

Figure 10:
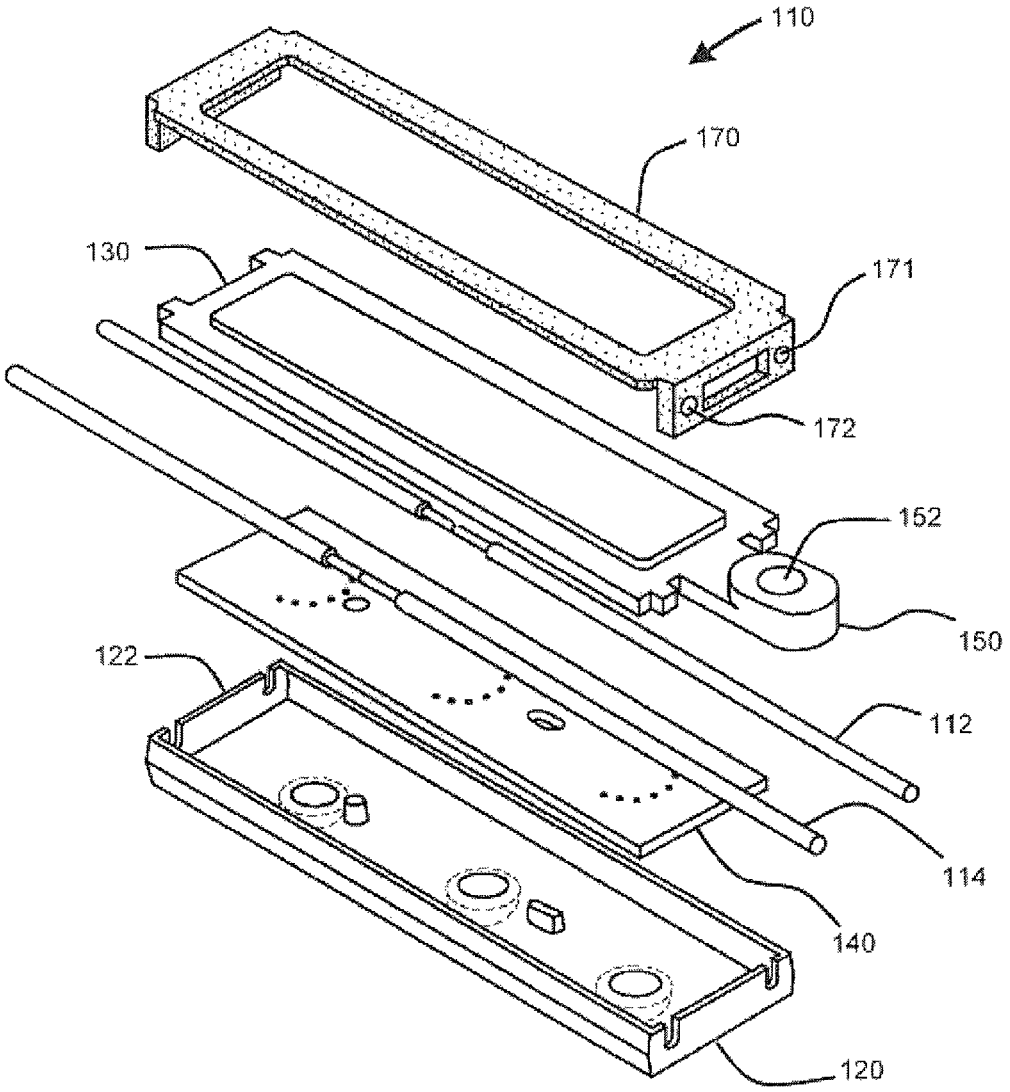
FIG. 10 is an exploded view of a first alternate embodiment of the invention wherein the sealant material does not contact the printed circuit board.

As may be seen in FIG. 10, extending from one end of the LED light engine 110 is a projection 150 including a hole 152 formed therein.

Surrounding the insulated wires 112, 114 is the sealant material 170 which holds the insulated wires 112, 114 in place and acts as a strain relief 171, 172. The sealant material 170 provides durability, protects the LED light engine 110 from moisture and holds the components of the LED light engine 110. As may be seen in FIG. 11, the sealant material 170 not only surrounds the insulated wires 112, 114 but also contacts each downwardly depending end 122 of the top enclosure 120 as shown in FIG. 11.

As may be seen in FIG. 10, the shape and features of the bottom enclosure 130 in the first alternate embodiment are different from the shape and features of the bottom enclosure 130 in the preferred embodiment. This set of features in bottom enclosure 130 causes the sealant material 170 to flow differently than the sealant material 170 in the preferred embodiment.

Figure 11A:
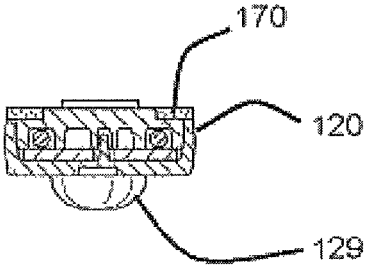
FIG. 11A is a cross-sectional view at line "A-A" in FIG. 11.

As may be seen in FIG. 10, the sealant material 170 does not flow over the top of the bottom enclosure 130, but instead flows thereunder. Such flow of the sealant material 170 is also illustrated in FIG. 11 and in FIG. 11A. While no portion of the sealant material 170 comes into contact with the printed circuit board 140, the sealant material 170 holds the components of the first alternate embodiment of the LED light engine 110 together and seals the electric componentry contained therein from the corrosive effects of moisture.

Figure 12:
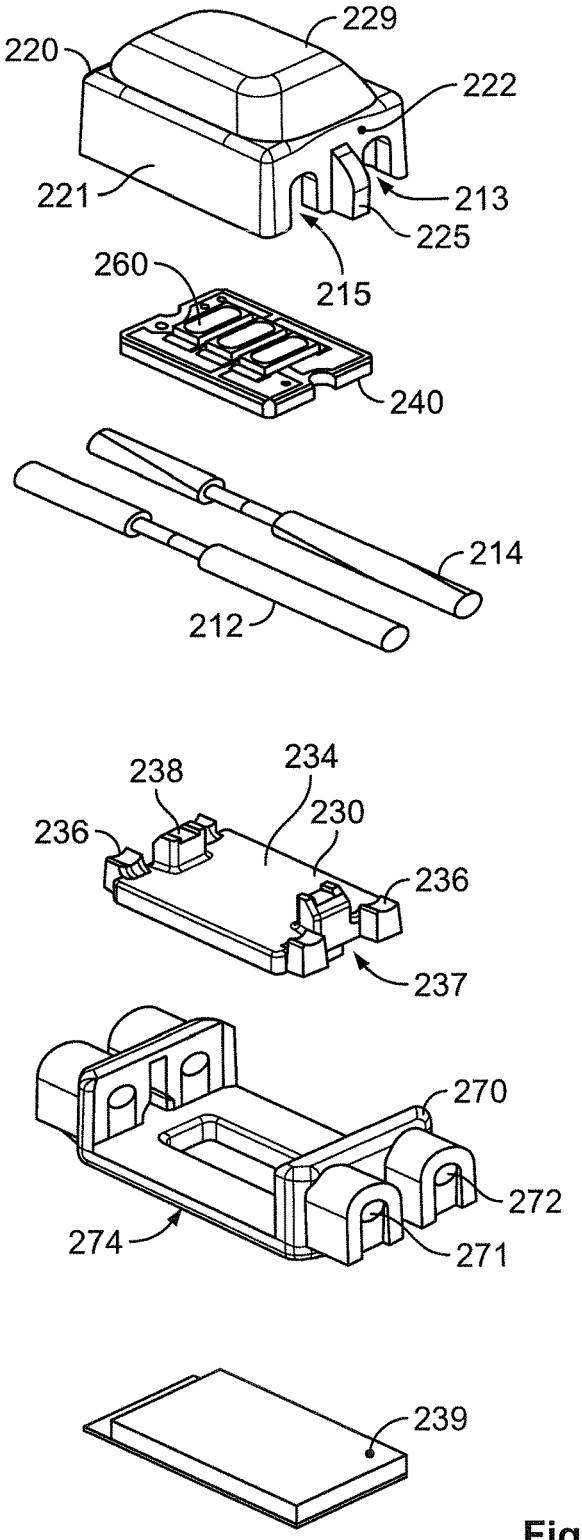
FIG. 12 is an exploded view of a second alternate embodiment of the invention.
Figure 13:
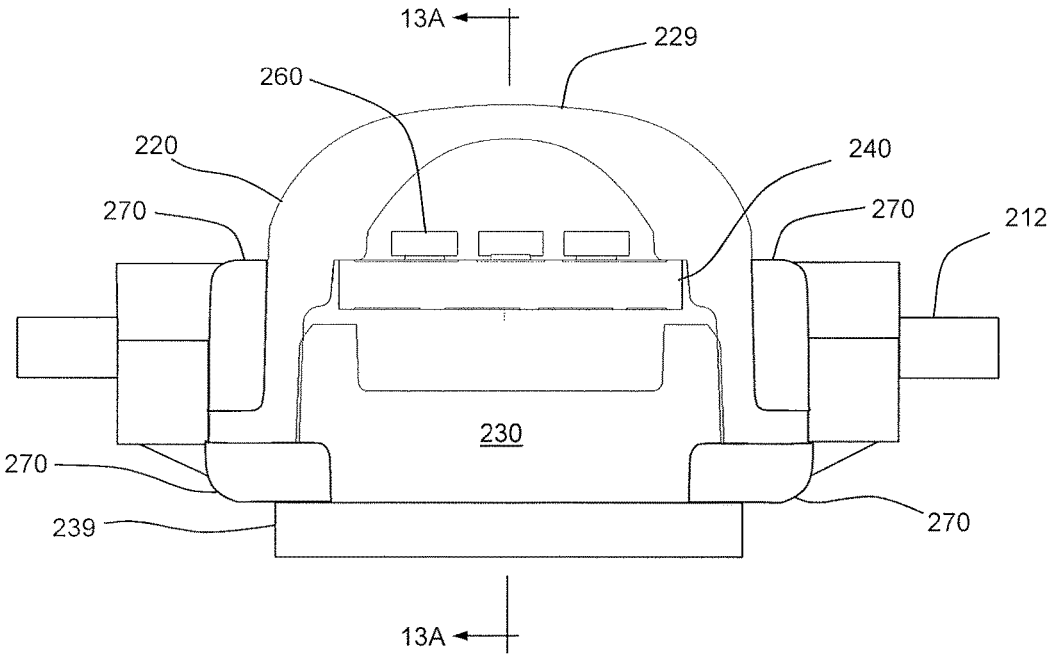
FIG. 13 is a cross-sectional view of the second alternate embodiment of the invention similar to FIG. 11.
Figure 13A:
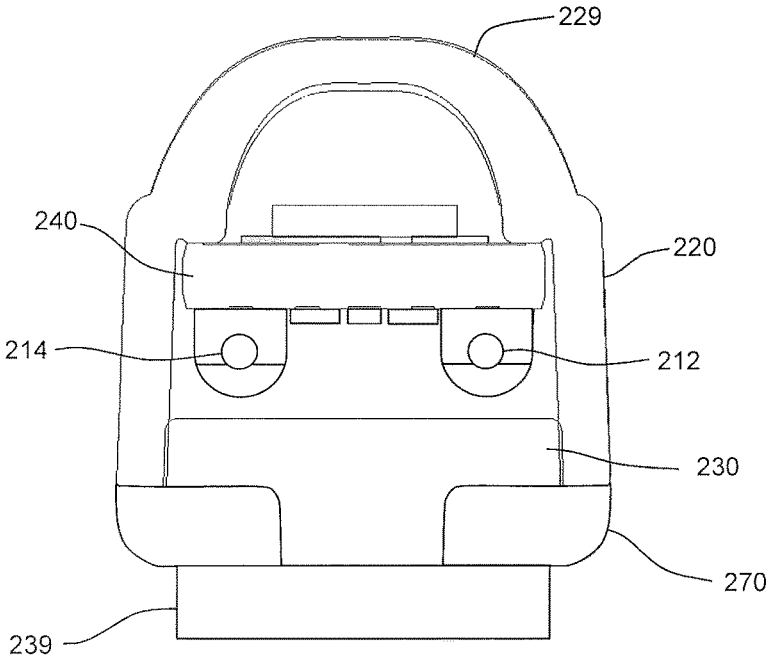
FIG. 13A is a cross-sectional view of the second alternate embodiment of the invention at line "13A-13A" in FIG. 13.

A second alternate embodiment is shown in FIG. 12, FIG. 13 and FIG. 13A. Those of ordinary skill in the art will understand that the second alternate embodiment 210 is similar to the preferred embodiment 10 and the first alternate embodiment 110. Accordingly, the reference numbers used to describe the parts of the second alternate embodiment are the same, but for the number "2" in the hundreds place of the reference numbers.

In the second alternate embodiment, the top portion of the LED light engine 210 is a substantially U-shaped top enclosure 220. Included in the substantially U-shaped top enclosure 220 is lens 229, wherein lens 229 can be positioned over multiple LEDs 260. FIG. 12 shows a single lens 229, but other embodiments may include more than one lens 229, particularly having one lens 229 for each LED 260.

As in the preferred and first alternate embodiments, insulated wires 212, 214 provide electrical energy to power LEDs 260, as well as to enable the connection of one LED light engine 210 to another. Insulated wires 212, 214 extend from the ends of the LED light engine 210. The top surface of bottom enclosure 230 includes channels 236 which are sized and shaped for positioning insulated wires 212, 214 therein. Although insulated wires 212, 214 tend to run the length of bottom enclosure 230, as is shown particularly in FIG. 12, channels 236 are generally located at each of the corners of the top surface of bottom enclosure 230. Channels 236 are sized and shaped to enable the position of insulated wires 212, 214. The downwardly depending ends 222 of substantially U-shaped top enclosure 220 have a general "m" shape which includes arch-shaped openings 213, 215 which assist in the placement of the insulated wires 212, 214 when the substantially U-shaped top enclosure 220, the printed circuit board 240 and the bottom enclosure 230 are assembled together.

Positioned between arch-shaped openings 213, 215 on downwardly depending ends 222, and forming the inner wall of each of the arch-shaped openings 213, 215, is middle post 225. Each end of bottom enclosure 230 has a corresponding recess 237. Middle post 225 is sized and shaped so as to engage with recess 237 in a press-fit interface when the substantially U-shaped top enclosure 220 and bottom enclosure 230 are assembled together in the assembly of LED light engine 210.

Surrounding the insulated wires 212, 214 is a sealant material 270 which holds the insulated wires 212, 214 in place and acts as a strain relief 271, 272. The sealant material 270 provides durability, protects the LED light engine 210 from moisture and holds the components of the LED light engine 210 together.

As can be seen in FIG. 12, the shape and features of bottom enclosure 230 are different than the shape and features of bottom enclosures 30 and 130 as illustrated with respect to other disclosed embodiments. In part, these differences result in a different pattern of flow with respect to sealant material 270, as explained in further detail below. Bottom enclosure 230 has a top surface 234. Positioned on the top surface 234, at each end of bottom enclosure 230, are raised tabs 238 which extend vertically from the top surface 234. When top enclosure 220, printed circuit board 240, and bottom enclosure 230 are assembled in LED light engine 210, raised tabs 238 fit between insulated wires 212, 214 and assist in properly aligning printed circuit board 240 in position with respect to bottom enclosure 230.

The shapes of substantially U-shaped top enclosure 220 and bottom enclosure 230 are such the interface between substantially U-shaped top enclosure 220 and bottom enclosure 230 results in a press fit or interference fit. A result of this press-fit interface is that sealant material 270 does not flow between substantially U-shaped top enclosure 220 and bottom enclosure 230, but rather sealant material 270 flows around the outer surface of, as well as under, LED light engine 210, as shown in FIG. 13 and FIG. 13A. Contact between sealant material 270 and at least a portion of the bottom surface of substantially U-shaped top enclosure 220 is shown. Also shown in FIG. 13 and FIG. 13A, sealant material 270 contacts at least a portion of the bottom enclosure 230. No portion of sealant material 270 contacts printed circuit board 240.

One method of attaching LED light engine 210 to a surface is through the use of two-sided tape 239. Two-sided tape 239 may be placed on the bottom surface 274 of the sealant material 270. Other methods of attaching LED light engine 210 to a surface may be used as would be understood by those of ordinary skill in the art.

Another result of having substantially U-shaped top enclosure 220 and bottom enclosure 230 press fit together is the elimination of the particular alignment projections, alignment holes, and alignment receptacles which are shown and described with respect to LED light engine 10 and LED light engine 110. Thus, as shown in the illustrated embodiment of LED light engine 210, no similar alignment projections or alignment receptacles are present on the bottom surface of top enclosure 220 or the top surface of bottom enclosure 230, such as those illustrated with respect to the preferred and first alternate embodiments. Printed circuit board 240 also does not have the particular alignment holes which correspond with the alignment projections and alignment receptacles shown with respect to LED light engine 10 and LED light engine 110.

While the present invention has been described according to its preferred embodiment, those of ordinary skill in the art will understand that modifications to the preferred embodiment may be made without departing from the scope and meaning of the appended claims.

What is claimed is:

1. An LED light engine comprising:

a printed circuit board including:

a top surface on which is mounted at least one LED;

a bottom surface on which is mounted electronic componentry and insulated wires;

at least one alignment hole between said top surface and said bottom surface;

an edge surrounding said printed circuit board between said top and bottom surfaces;

a substantially U-shaped top enclosure including:

a top surface having at least one lens formed therein;

downwardly depending sides for surrounding said edge of said printed circuit board;

a bottom surface having at least one alignment piece constructed and arranged to pass through said at least one alignment hole in said printed circuit board;

a bottom enclosure including:

a top surface including at least one alignment receptacle formed therein and a pair of channels extending the length of said top surface;

said pair of channels constructed and arranged to position said insulated wires;

a sealant material enabling:

forming a strain relief around said insulated wires at either end of said substantially U-shaped top enclosure;

affixing said downwardly dependent sides of said substantially U-shaped top enclosure and said bottom enclosure one to another.

2. The LED light engine as defined in claim 1 further including a projection having a mounting hole formed therein, said projection extending from the end of said bottom enclosure.

3. The LED light engine as defined in claim 1 wherein the top of said printed circuit board is in physical contact with a portion of the bottom surface of said substantially U-shaped top enclosure and the bottom of said printed circuit board is in physical contact with a portion of the top surface of said bottom enclosure.

4. The LED light engine as defined in claim 1 wherein said sealant material is not in contact with the top or bottom surface of said printed circuit board.

5. The LED light engine as defined in claim 2 wherein the projection having a hole formed therein and extending from the end of the bottom enclosure.

6. A method for making an LED light engine comprising:

constructing a printed circuit board including:

a top surface on which is mounted at least one LED;

a bottom surface on which is mounted electronic componentry and insulated wires;

a least one alignment hole between said top surface and said bottom surface;

an edge between said top surface and said bottom surface;

constructing a substantially U-shaped top enclosure including:

a top surface having a number of lenses equal to the number of LEDs on said top surface of said printed circuit board;

downwardly depending sides for surrounding said edge of said printed circuit board;

a bottom surface having alignment pieces constructed and arranged to pass through said at least one alignment hole in said printed circuit board;

constructing a bottom enclosure including:

a top surface including at least one alignment receptacle formed therein and a pair of channels extending the length of said top surface, said pair of channels formed to position said insulated wires;

placing said printed circuit board between said downwardly dependent sides of said substantially U-shaped top enclosure and aligning it therewith by placing said at least one alignment hole over said at least one alignment piece;

placing said top of said bottom enclosure over the bottom of said printed circuit board and aligning it therewith by alignment of said at least one alignment receptacle with said alignment pieces on the bottom of said substantially U-shaped top enclosure;

placing said combination of said substantially U-shaped top enclosure, said printed circuit board and said bottom enclosure in a plastic mold;

injecting plastic sealant into said combination of said substantially U-shaped top enclosure, said printed circuit board and said bottom enclosure enabling:

forming a strain relief around said insulated wires at either end of said substantially U-shaped top enclosure;

affixing said downwardly dependent side of said substantially U-shaped top enclosure and said bottom enclosure one to another.

7. The method of claim 6 wherein the top of said printed circuit board is in physical contact with a portion of the bottom surface of said substantially U-shaped top enclosure and the bottom of said printed circuit board is in physical contact with a portion of the top surface of said bottom enclosure.

8. An LED light engine comprising:

a printed circuit board including:

a top surface on which is mounted at least one LED and supporting electronic componentry;

a bottom surface;

at least one alignment hole between said top surface and said bottom surface;

an edge surrounding said printed circuit board between said top and bottom surfaces;

a substantially U-shaped top enclosure including:

a top surface having at least one lens formed therein;

downwardly depending sides for surrounding said edge of said printed circuit board;

a bottom surface having at least one alignment piece constructed and arranged to pass through said it least one alignment hole in said printed circuit board;

a bottom enclosure including;

a top surface including at least one alignment receptacle formed therein and a pair of channels extending the length of said top surface;

said pair of channels constructed and arranged to position said insulated wires;

a sealant material enabling:

forming a strain relief around said insulated wires at either end of said substantially U-shaped top enclosure;

affixing said downwardly dependent sides of said substantially U-shaped top enclosure and said bottom enclosure one to another.

9. The LED light engine as defined in claim 8 further including a projection having a mounting hole formed therein, said projection extending from the end of said bottom enclosure.

10. The LED light engine as defined in claim 8 wherein the top of said printed circuit board is in physical contact with a portion of the bottom surface of said substantially U-shaped top enclosure and the bottom of said printed circuit board is in physical contact with a portion of the top surface of said bottom enclosure.

11. The LED light engine as defined in claim 8 wherein said sealant material is not in contact with the top or bottom surface of said printed circuit board.

12. The LED light engine as defined in claim 9 wherein the projection having a hole formed therein and extending from the end of the bottom enclosure.

13. An LED light engine comprising:

a printed circuit board including:

a top surface on which is mounted at least one LED;

a bottom surface on which is mounted electronic componentry and insulated wires;

an edge surrounding said printed circuit board between said top and bottom surfaces;

a substantially U-shaped top enclosure including:

a top surface having at least one lens formed therein;

downwardly depending sides for surrounding said edge of said printed circuit board;

a bottom enclosure including a top surface including channels constructed and arranged to position said insulated wires, the channels extending the length of said top surface;

a sealant material enabling forming a strain relief around said insulted wires to either end of said substantially U-shaped top enclosure; and said substantially U-shaped top enclosure and said bottom enclosure are press fit together wherein a portion of an inner surface of said substantially U-shaped top enclosure contacts a portion of an outer surface of said bottom enclosure.

14. The LED light engine as defined in claim 13 wherein the top of said printed circuit board is in physical contact with a portion of the bottom surface of said substantially U-shaped top enclosure and the bottom of said printed circuit board is in physical contact with a portion of the top surface of said bottom enclosure.

15. The LED light engine as defined in claim 13 wherein said sealant material is not in contact with the top or bottom surface of said printed circuit board.

* * * * *